US008977169B2

(12) United States Patent
Shimizu et al.

(10) Patent No.: US 8,977,169 B2
(45) Date of Patent: Mar. 10, 2015

(54) TONER SUPPLY SYSTEM FOR IMAGE FORMING APPARATUS DEVELOPMENT DEVICE

(71) Applicant: Kyocera Document Solutions Inc., Osaka-shi, Osaka (JP)

(72) Inventors: Tamotsu Shimizu, Osaka (JP); Takahisa Nakaue, Osaka (JP); Teruhiko Nagashima, Osaka (JP); Takashi Morita, Osaka (JP)

(73) Assignee: Kyocera Document Solutions Inc. (JP)

( * ) Notice: Subject to any disclaimer, the term of this patent is extended or adjusted under 35 U.S.C. 154(b) by 209 days.

(21) Appl. No.: 13/677,346

(22) Filed: Nov. 15, 2012

(65) Prior Publication Data

US 2013/0136502 A1 May 30, 2013

(30) Foreign Application Priority Data

Nov. 25, 2011 (JP) ..... 2011-257523
Nov. 25, 2011 (JP) ..... 2011-257524

(51) Int. Cl.
*G03G 15/00* (2006.01)
*G03G 15/08* (2006.01)

(52) U.S. Cl.
CPC ..... *G03G 15/0836* (2013.01); *G03G 15/0893* (2013.01); *G03G 15/0877* (2013.01)
USPC ..... 399/258; 399/260; 399/120

(58) Field of Classification Search
CPC ..... G03G 15/08; G03G 15/0839; G03G 15/0891; G03G 2215/0827
USPC ..... 399/258, 260, 263, 255, 256
See application file for complete search history.

(56) References Cited

U.S. PATENT DOCUMENTS 5,963,766 A * 10/1999 Okuno et al. ..... 399/256
2006/0204283 A1 9/2006 Yasuda
2009/0154972 A1 6/2009 Tanaka et al.
2010/0239273 A1* 9/2010 Kawasaki ..... 399/27

FOREIGN PATENT DOCUMENTS

JP 04-175782 6/1992
JP 2005-346116 12/2005

(Continued)

*Primary Examiner* — Benjamin Schmitt
*Assistant Examiner* — Matthew Miller
(74) *Attorney, Agent, or Firm* — Gerald E. Hespos; Michael J. Porco; Matthew T. Hespos

(57) ABSTRACT

A development device includes a developer introduction port, a developer conveyance portion, a first conveyance ability suppressing portion, and a connecting conveyance portion. The conveyance ability suppressing portion is disposed on a downstream side of the developer introduction port in a first direction in which the developer is conveyed in order to partially suppress a developer conveyance ability of the developer conveyance portion such that a developer accumulation portion is formed in a position opposing the developer introduction port. A first direction downstream side of the first conveyance ability suppressing portion opposes a first connecting passage in a third direction that intersects the first direction. The connecting conveyance portion is joined to the first direction downstream side of the conveyance ability suppressing portion and opposes the first connecting passage in the third direction in order to pass the developer from a first conveyance passage to a second conveyance passage.

12 Claims, 14 Drawing Sheets

(56) References Cited

FOREIGN PATENT DOCUMENTS

| | | |
|---|---|---|
| JP | 2006-267204 | 10/2006 |
| JP | 2009-237223 | 10/2009 |
| JP | 2010-152109 | 7/2010 |

* cited by examiner

TONER SUPPLY SYSTEM FOR IMAGE FORMING APPARATUS DEVELOPMENT DEVICE

This application is based on Japanese Patent Application No. 2011-257523 and Japanese Patent Application No. 2011-257524, filed with the Japan Patent Office on Nov. 25, 2011, the contents of which are incorporated herein by reference.

BACKGROUND

The present disclosure relates to a development device that can be installed suitably in an image forming apparatus such as a copier or a printer, and an image forming apparatus including the development device.

A conventional development device includes a development housing having a development roller and a stirring screw, and a toner container that replenishes toner and is attached to the development housing detachably. A toner discharge port that can be opened and closed is provided in a bottom portion of the toner container, and a toner replenishment port is provided in the development housing in a position corresponding to the toner discharge port. When the toner container is attached to the development housing and both the toner discharge port and the toner replenishment port are opened, toner in the toner container is supplied to a predetermined circulatory conveyance passage formed in the development housing.

The circulatory conveyance passage is constituted by an outward conveyance passage corresponding to the toner replenishment port and a return conveyance passage corresponding to the development roller. A stirring screw in which a spiral vane is disposed around a rotary shaft is mounted in each circulatory conveyance passage. The toner is conveyed in circulatory fashion between the outward conveyance passage and the return conveyance passage by the respective stirring screws.

In a conventional development device having this type of configuration, a conveyance ability suppressing portion may be provided on the stirring screw provided in the outward conveyance passage on a downstream side of the toner replenishment port in order to reduce a conveyance ability locally. A toner accumulation portion is formed by the conveyance ability suppressing portion in the vicinity of the toner replenishment port on an upstream side of the conveyance ability suppressing portion. When a large amount of toner exists in the accumulation portion, the toner in the accumulation portion blocks the toner replenishment port. Further, when the amount of toner in the accumulation portion is small, a gap is formed between the toner replenishment port and the toner accumulation portion such that toner flows into the development housing from the toner container side. Thus, an amount of replenishment toner supplied to the development housing from the toner container is regulated in accordance with the amount of accumulated toner in the accumulation portion.

When determining an interior layout of an image forming apparatus main body installed with the development device described above, it may be desirable to connect the toner container to an end portion of the development housing in an extension direction of the rotary shaft. In this case, the toner replenishment port is disposed in an end portion of the outward conveyance passage. However, a connecting passage connecting the outward conveyance passage to the return conveyance passage is close to this end portion, and therefore developer accumulates easily therein. Hence, when the toner replenishment port is disposed in the end portion of the outward conveyance passage, developer accumulation in the vicinity of the connecting passage affects the accumulation portion formed by the conveyance ability suppressing portion, and as a result, toner replenishment regulation becomes unstable.

An object of the present disclosure is to provide a development device in which replenishment developer is supplied from a replenishment developer housing portion as an amount of developer in a developer accumulation portion decreases, with which the replenishment developer can be supplied with stability even when a developer introduction port is disposed in the vicinity of a connecting passage of a developer conveyance passage.

SUMMARY

A development device according to an aspect of the present disclosure includes a casing that houses a developer, a replenishment developer housing portion, a developer conveyance path, a developer introduction port, a developer conveyance portion, a first conveyance ability suppressing portion, and a connecting conveyance portion.

The replenishment developer housing portion is attached to the casing detachably and houses replenishment developer supplied to the casing.

The developer conveyance path is formed in the casing and includes a first conveyance passage through which the developer is conveyed in a first direction, a second conveyance passage which is disposed alongside the first conveyance passage, and through which the developer is conveyed in a second direction, which is an opposite direction to the first direction, a first connecting passage which connects a downstream side of the first conveyance passage to an upstream side of the second conveyance passage in a third direction that intersects the first direction, and a second connecting passage which connects a downstream side of the second conveyance passage to an upstream side of the first conveyance passage in a fourth direction, which is an opposite direction to the third direction.

The developer introduction port is provided in the casing to oppose a first direction downstream side position of the first conveyance passage, and the replenishment developer is introduced into the developer conveyance path from the replenishment developer housing portion through the developer introduction port.

The developer conveyance portion is disposed in the first conveyance passage to convey the developer in the first direction so that the developer passes the position in which the developer introduction port opposes the first conveyance passage.

The first conveyance ability suppressing portion is disposed on the developer conveyance portion on a downstream side of the developer introduction port in said first direction in order to partially suppress a developer conveyance ability of the developer conveyance portion such that a developer accumulation portion for regulating an introduction amount of the replenishment developer is formed in a position opposing the developer introduction port, and such that a first direction downstream side thereof opposes the first connecting passage in the third direction.

The connecting conveyance portion is joined to the first direction downstream side of the first conveyance ability suppressing portion in the developer conveyance portion and opposes the first connecting passage in the third direction in order to pass the developer from the first conveyance passage to the second conveyance passage.

An image forming apparatus according to another aspect of the present disclosure includes an image carrier having a surface on which an electrostatic latent image is formed, wherein the electrostatic latent image is formed into a visible developer image using a developer, and a development device that supplies the developer to the image carrier. The development device is configured as described above.

DETAILED DESCRIPTION

Figure 1:
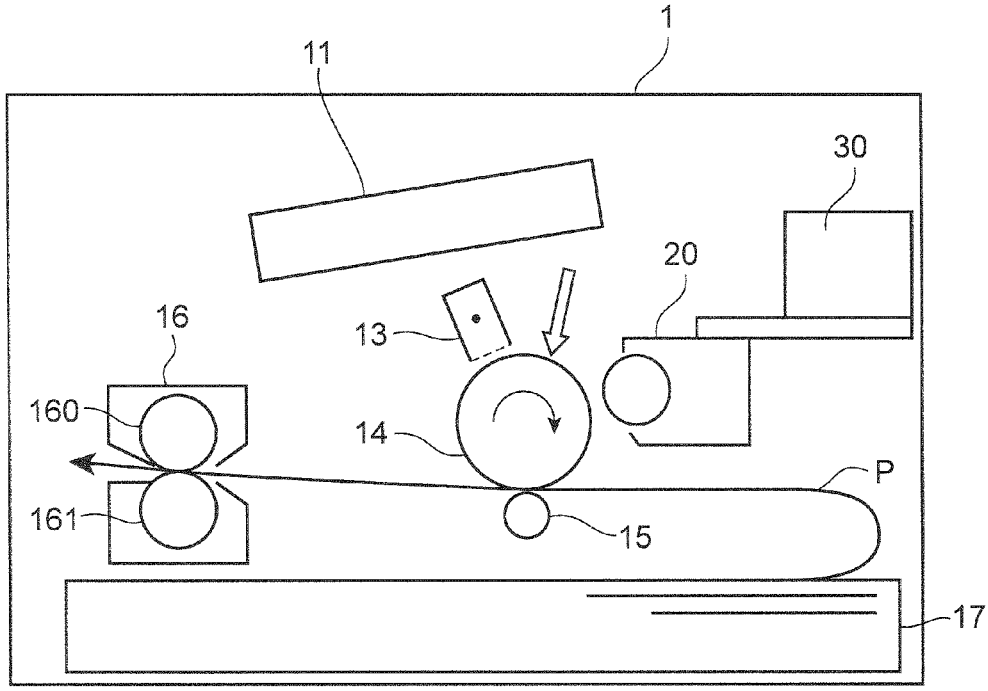
FIG. 1 is a schematic view illustrating an internal structure of an image forming apparatus according to an embodiment of the present disclosure.

Embodiments of the present disclosure will be described below on the basis of the drawings. FIG. 1 is a schematic sectional view showing a configuration of an image forming apparatus 1 including a development device 20 according to an embodiment of the present disclosure. The image forming apparatus 1 includes an optical scanning device 11, the development device 20, a toner container 30 (a replenishment developer housing portion), a charger 13, a photosensitive drum 14 (an image carrier), a transfer roller 15, a fixer 16, and a sheet feeding cassette 17.

The photosensitive drum 14 is a cylindrical member having a peripheral surface on which an electrostatic latent image and a toner image are formed. The photosensitive drum 14 is rotated in a clockwise direction of FIG. 1 upon reception of driving force from a motor, not shown in the drawing. The charger 13 charges a surface of the photosensitive drum 14 substantially uniformly.

The optical scanning device 11 includes a light source such as a laser diode, a deflector, a scanning lens, an optical element, and so on. The optical scanning device 11 forms an electrostatic latent image of image data by irradiating the peripheral surface (a scanned surface) of the photosensitive drum 14 substantially uniformly charged by the charger 13 with laser light corresponding to the image data.

The development device 20 forms a toner image by supplying toner to the peripheral surface of the photosensitive drum 14 on which the electrostatic latent image is formed. The development device 20 includes a development roller that carries the toner and a stirring screw that stirs and conveys the toner. The toner image formed on the photosensitive drum 14 is transferred onto a sheet that is fed from the sheet feeding cassette 17 and conveyed along a conveyance path P. The development device 20 is replenished with toner from the toner container 30. The development device 20 will be described in detail below.

The toner container 30 is a box-shaped member that houses toner in its interior. The toner container 30 supplies toner to the development device 20. The toner container 30 is attached to the development device 20 detachably.

The transfer roller 15 is disposed below and opposite the photosensitive drum 14 such that a transfer nip portion is formed therebetween. The transfer roller 15 is constituted by a conductive rubber material or the like. Further, a transfer bias is applied to the transfer roller 15 by bias applying means, not shown in the drawing. The transfer roller 15 transfers the toner image formed on the photosensitive drum 14 onto the sheet.

The fixer 16 includes a fixing roller 160 having an inbuilt heater, and a pressurizing roller 161 provided in a position opposing the fixing roller 160. The fixer 16 conveys the sheet formed with the toner image while heating the sheet such that the toner image formed on the sheet is fixed.

<Description of Development Device>

Figure 2:
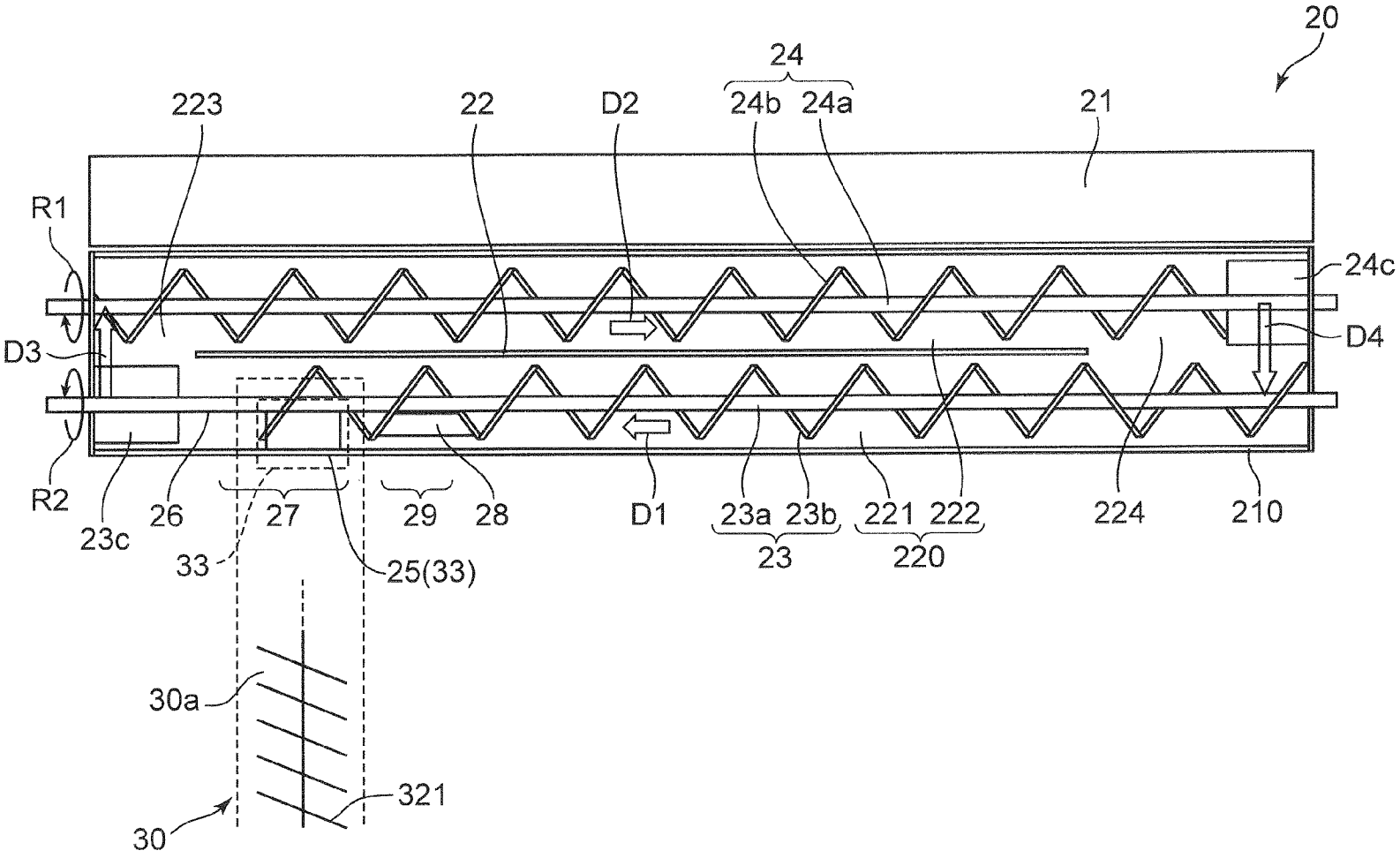
FIG. 2 is a plan view of a development device according to an embodiment of the present disclosure.

FIG. 2 is a plan view showing an internal structure of the development device 20. The development device 20 includes a development housing 210 (a casing) having an elongated box shape that extends in one direction (an axial direction of a development roller 21). The development housing 210 includes an interior space 220 and a toner replenishment port 25. The development roller 21, a first stirring screw 23 (a developer conveyance portion), and a second stirring screw 24 are disposed in the interior space 220. When a single component development method is employed, toner is filled into the interior space 220 as a developer. When a two component development method is employed, a mixture of toner and a carrier constituted by a magnetic body is filled as the developer. The toner is conveyed through the interior space 220 while being stirred, and supplied to the photosensitive drum 14 successively from the development roller 21 in order to develop the electrostatic latent image.

The development roller 21 has a cylindrical shape that extends in an elongation direction of the development housing 210, and includes a sleeve part that is driven to rotate on an outer periphery thereof. When the single component development method is employed, toner carrying a charge due to frictional electrification is adhered to the sleeve part from the second stirring screw 24. When the two component development method is employed, a magnetic field formed by a magnetic pole disposed fixedly in a sleeve interior causes the carrier constituted by the magnetic body to adhere to a sleeve surface from the second stirring screw 24 together with the toner, which is adhered by electrostatic force. The toner (developer) carried on the sleeve surface is conveyed to an opening portion (not shown) provided in the development housing 210, and supplied to the opposing photosensitive drum 14.

The interior space 220 of the development housing 210 is covered by a top plate, not shown in the drawing, and divided by a partition plate 22 extending in a left-right direction into a first conveyance passage 221 and a second conveyance passage 222 that are parallel to each other and formed in an elongated shape extending in the left-right direction. The partition plate 22 is shorter than a left-right direction width of the development housing 210 such that a first connecting passage 223 and a second connecting passage 224 connecting the first conveyance passage 221 to the second conveyance passage 222 are formed respectively on a left end and a right end of the partition plate 22. As a result, a circulation path (a developer conveyance path) constituted by the first conveyance passage 221, the first connecting passage 223, the second conveyance passage 222, and the second connecting passage 224 is formed in the interior space 220. The toner is conveyed along the circulation path in a clockwise direction in FIG. 2. Hence, the first connecting passage 223 connects a downstream side of the first conveyance passage 221 in a toner conveyance direction to an upstream side of the second conveyance passage 222, while the second connecting passage 224 connects a downstream side of the second conveyance passage 222 to an upstream side of the first conveyance passage 221.

The toner replenishment port 25 (a developer introduction port) is an opening portion perforated into the top plate and disposed above the vicinity of a left end of the first conveyance passage 221 (FIG. 2). The toner replenishment port 25 is disposed to face the circulation path described above, and functions to introduce replenishment toner (replenishment developer) supplied from the toner container 30 into the circulation path (the interior space 220).

The first stirring screw 23 is disposed in the first conveyance passage 221. The first stirring screw 23 includes a first rotary shaft 23*a* (a rotary shaft), and a first spiral vane 23*b* (a screw vane) that projects in a spiral shape from a periphery of the first rotary shaft 23*a*. The first stirring screw 23 is driven to rotate about the first rotary shaft 23*a* (arrow R2) in order to convey the toner in a direction of an arrow D1 in FIG. 2 (a first direction). The first stirring screw 23 conveys the developer so that the developer passes the position in which the toner replenishment port 25 opposes the first conveyance passage 221. The first stirring screw 23 thus has a function for mixing the toner conveyed through the first conveyance passage 221 with new toner flowing in through the toner replenishment port 25, and passing the mixed toner to the second conveyance passage 222 side.

A first paddle 23*c* (a connecting conveyance portion) is disposed on a downstream side of the first stirring screw 23 in the toner conveyance direction (the D1 direction). The first paddle 23*c* is a plate-shaped member disposed on the first rotary shaft 23*a* so as to face the first connecting passage 223. The first paddle 23*c* rotates together with the first rotary shaft 23*a* in order to pass the toner from the first conveyance passage 221 to the second conveyance passage 222 in a direction of an arrow D3 in FIG. 2 (a third direction).

The second stirring screw 24 is disposed in the second conveyance passage 222. The second stirring screw 24 includes a second rotary shaft 24*a*, and a second spiral vane 24*b* that projects in a spiral shape from a periphery of the second rotary shaft 24*a*. The second stirring screw 24 is driven to rotate about the second rotary shaft 24*a* (arrow R1) in order to convey the toner in a direction of an arrow D2 in FIG. 2 (a second direction). The second stirring screw 24 conveys the toner through the second conveyance passage 222 and supplies the toner to the development roller 21. A second paddle 24*c* is disposed on a downstream side of the second stirring screw 24 in the toner conveyance direction (the D2 direction). The second paddle 24*c* is a plate-shaped member disposed on the second rotary shaft 24*a*. The second paddle 24*c* rotates together with the second rotary shaft 24*a* in order to pass the toner from the second conveyance passage 222 to the first conveyance passage 221 in a direction of an arrow D4 in FIG. 2 (a fourth direction).

The toner container 30 is disposed above the toner replenishment port 25 of the development housing 210. The toner container 30 includes an interior toner conveyance passage 30*a* through which the toner is conveyed, a toner conveyance member 321, and a toner discharge port 33. The toner container 30 is incorporated into the development device 20 such that a lengthwise direction (a formation direction of the toner conveyance passage 30*a*) of the toner container 30 is positioned in an orthogonal direction to a lengthwise direction (the developer conveyance direction of the first stirring screw 23, i.e. the arrow D1 direction) of the development device 20.

The toner discharge port 33 is provided in a bottom portion of the toner container 30 so as to oppose the toner replenishment port 25 of the development device 20. The toner conveyance member 321 includes a shaft portion and a vane portion that rotates about the shaft portion (see FIG. 3), and conveys replenishment toner in the toner conveyance passage 30*a* toward the toner discharge port 33. Toner that falls through the toner discharge port 33 is supplied to the development device 20 via the toner replenishment port 25.

<Toner Conveyance Ability Suppressing Portion>

The first stirring screw 23 includes a conveyance ability suppressing portion, in which a toner conveyance ability is suppressed in comparison with other parts, in two separate locations in an axial direction of the first rotary shaft 23*a*. More specifically, the first stirring screw 23, when disposed in the first conveyance passage 221, includes a first conveyance ability suppressing portion 26 positioned on a downstream side of the toner replenishment port 25 in the toner conveyance direction (the D1 direction), and a second conveyance ability suppressing portion 28 positioned on an upstream side of the toner replenishment port 25. The first conveyance ability suppressing portion 26 partially suppresses the toner conveyance ability such that a toner accumulation portion 27 for regulating a toner introduction amount is formed in a position facing the toner replenishment port 25. The second conveyance ability suppressing portion 28 partially suppresses the toner conveyance ability such that an upstream side accumulation portion 29 in which the toner accumulates is formed on the upstream side of the toner replenishment port 25. The accumulation portions 27, 29 will be described in detail below.

<Re: Accumulation Portions>

Figure 3:
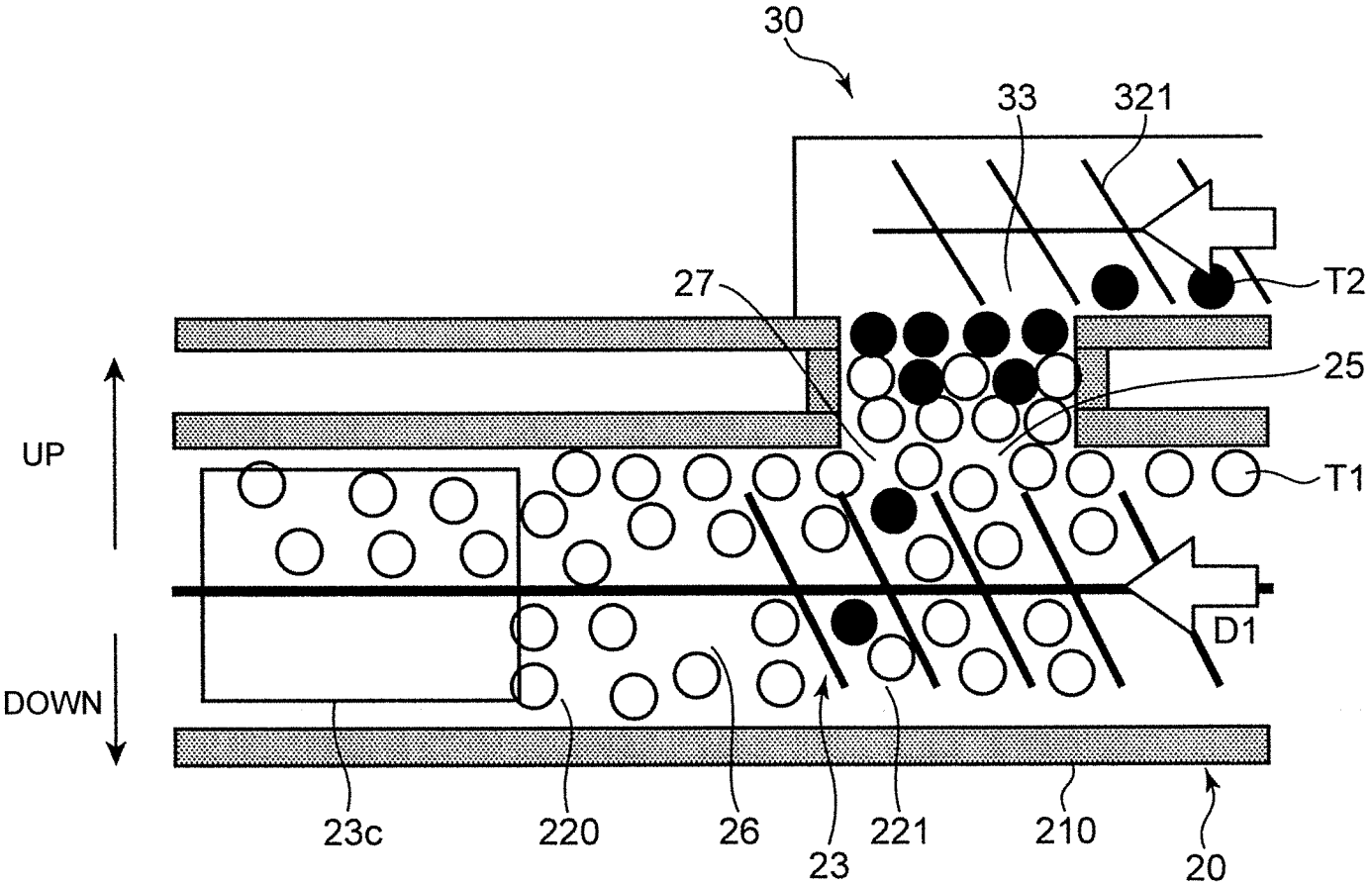
FIG. 3 is a sectional view of a toner replenishment portion.

To describe the accumulation portion 27, first, a flow of the toner newly introduced through the toner replenishment port 25 will be described. FIG. 3 is a sectional view showing the vicinity of the toner replenishment port 25 provided in the development device 20 and the toner discharge port 33 provided in the toner container 30. Note that for descriptive purposes, the toner container 30 has been rotated 90 degrees in a horizontal direction in FIG. 3. In actuality, the toner conveyance member 321 in the toner container 30 extends frontward toward a paper surface such that the first stirring screw 23 and the toner conveyance member 321 in the toner container 30 have a mutually orthogonal positional relationship.

Replenishment toner T2 supplied through the toner discharge port 33 in the toner container 30 falls into the first conveyance passage 221 so as to intermix with existing toner T1, whereupon the mixed toner T1, T2 is conveyed in the arrow D1 direction (the first direction) by the first stirring screw 23. At this time, the toner T1, T2 is stirred and electrified.

As described above, the first conveyance ability suppressing portion 26 in which the toner conveyance ability is partially suppressed is provided on the first stirring screw 23 on the downstream side of the toner replenishment port 25 in the toner conveyance direction. In this embodiment, the first conveyance ability suppressing portion 26 is formed by removing the first spiral vane portion 23*b* of the first stirring screw 23 (see FIG. 4). The first conveyance ability suppressing portion 26 therefore corresponds to a partial axial direction part in which only the first rotary shaft 23*a* exists. In this case, the first conveyance ability suppressing portion 26 does not have an ability to convey the toner in the axial direction of the first rotary shaft 23*a*. Hence, in the first conveyance passage 221, toner conveyed from an upstream side of the first conveyance ability suppressing portion 26 begins to accumulate in the first conveyance ability suppressing portion 26. The toner accumulates up to a position directly on the upstream side of the first conveyance ability suppressing portion 26 where the toner replenishment port 25 opposes the first conveyance passage 221, and as a result, the toner accumulation portion 27 (developer accumulation portion) is formed in the vicinity of an inlet of the toner replenishment port 25.

Note that in a case where the first stirring screw 23 of the development device 20 is controlled to different rotation speeds depending on operation conditions of the image forming apparatus 1, the first conveyance ability suppressing portion 26 is preferably constituted by a region in which only the first rotary shaft 23*a*, and not the first spiral vane 23*b*, is formed, as in this embodiment. In this case, the toner conveyance ability is suppressed irrespective of the rotation speed of the first stirring screw 23, and therefore the accumulation portion 27 is formed with stability.

When the replenishment toner T2 is supplied through the toner replenishment port 25 such that an amount of toner in the interior space 220 increases, the accumulated toner in the accumulation portion 27 blocks (seals) the toner replenishment port 25 such that further toner replenishment is suppressed. When the toner in the interior space 220 is consumed via the development roller 21 thereafter such that the amount of accumulated toner in the accumulation portion 27 decreases, the toner blocking the toner replenishment port 25 decreases such that a gap forms between the accumulation portion 27 and the toner replenishment port 25. As a result, the replenishment toner T2 flows into the interior space 220 through the toner replenishment port 25 again. Hence, this embodiment employs a volume replenishment type toner replenishment method in which the amount of introduced replenishment toner is adjusted as the amount of accumulated toner in the accumulation portion 27 decreases.

Figure 11:
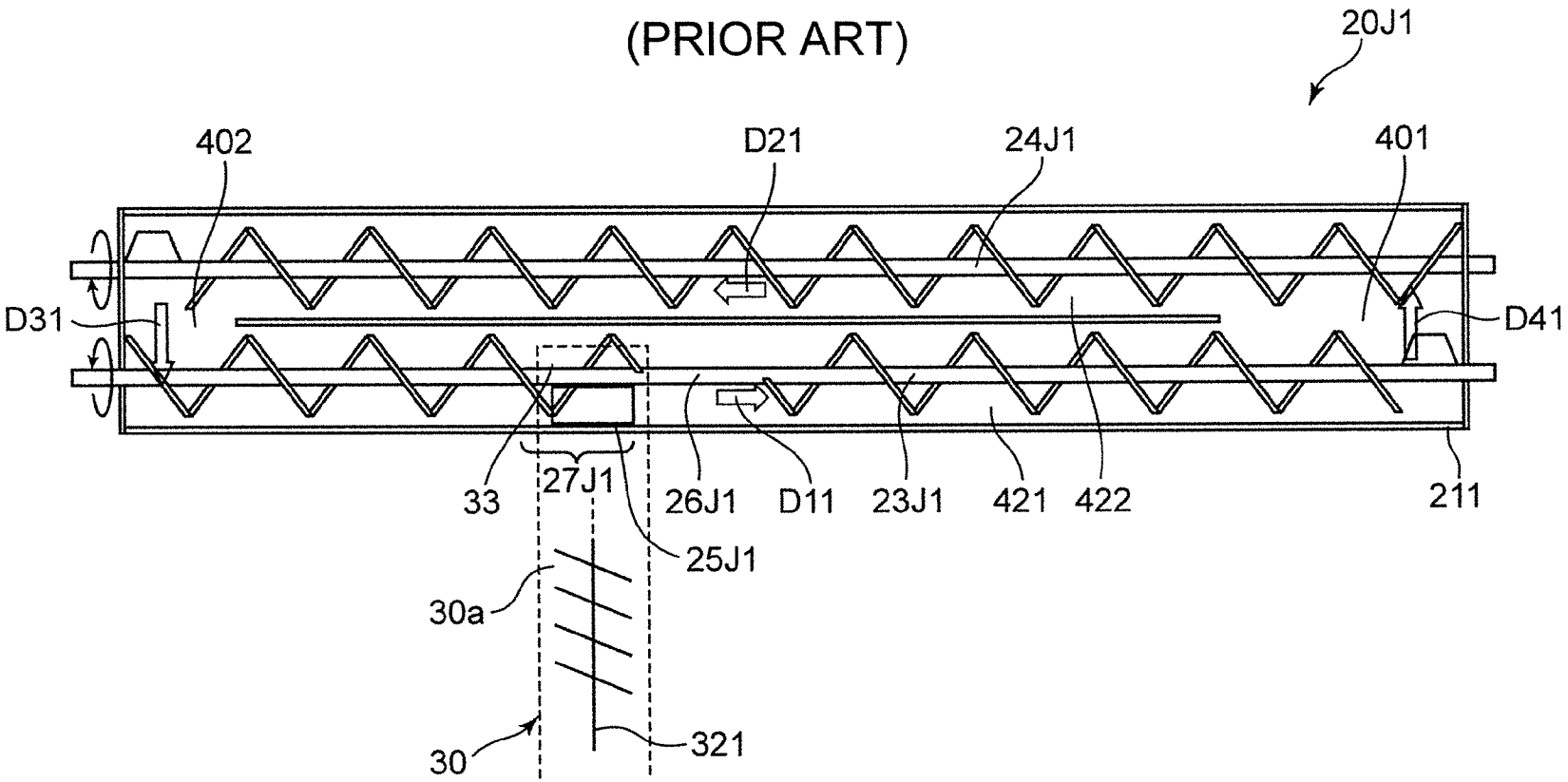
FIG.11 (PRIOR ART)
FIG. 11 is a plan view of a conventional volume replenishment type development device.

FIG. 11 shows a conventional development device 20J1 employing the volume replenishment type toner replenishment method. The development device 20J1 includes a circulation path constituted by a first conveyance passage 421, a first connecting passage 401, a second conveyance passage 422, and a second connecting passage 402. Toner is conveyed in circulatory fashion in directions of arrows D11, D41, D21, and D31 by first and second stirring screws 23J1, 24J1. A toner replenishment port 25J1 is provided in a substantially central portion of the first conveyance passage 421 in an axial direction. An accumulation portion 27J1 formed by a conveyance ability suppressing portion 26J1 of the first stirring screw 23J1 is formed in a position of the first conveyance passage 421 opposing the toner replenishment port 25J1, and the amount of replenishment toner supplied from the toner container 30 is regulated by increasing and decreasing the accumulation portion.

Figure 12:
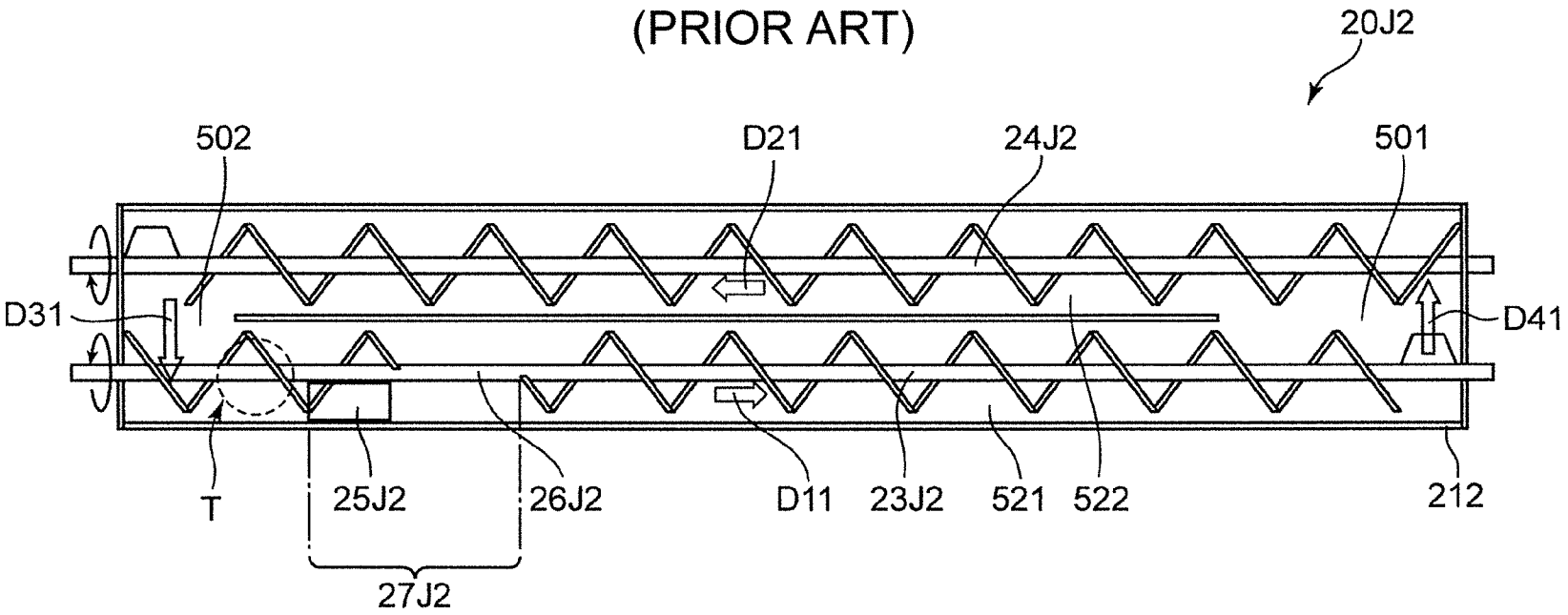
FIG.12 (PRIOR ART)
FIG. 12 is a plan view of a conventional volume replenishment type development device.

Here, when determining an interior layout of a main body of the image forming apparatus 1 installed with the development device described above, it may be desirable to connect the toner container 30 to an end portion of the development housing 212 in a rotary shaft extension direction. FIG. 12 shows a conventional development device 20J2 employing the volume replenishment type toner replenishment method. The development device 20J2 includes a circulation path constituted by a first conveyance passage 521, a first connecting passage 501, a second conveyance passage 522, and a second connecting passage 502. Toner is conveyed in circulatory fashion in the directions of the arrows D11, D41, D21, and D31 by first and second stirring screws 23J2, 24J2. A toner replenishment port 25J2 is provided in an upstream side end portion of the first conveyance passage 521 in the toner conveyance direction (the arrow D11), and the toner container 30 (not shown) is disposed to face the toner replenishment port 25J2. In this case, an accumulation portion 27J2 is formed by a conveyance ability suppressing portion 26J2 of the first stirring screw 23J2 so as to oppose the toner replenishment port 25J2.

The connecting passage 502 that connects the first conveyance passage 521 to the second conveyance passage 522, meanwhile, is disposed in the upstream side end portion of the first conveyance passage 521 in which the toner replenishment port 25J2 is provided. Hence, toner passed from the second conveyance passage 522 to the first conveyance passage 521 impinges on the accumulation portion 27J2 while being conveyed in the arrow D11 direction by the first stirring screw 23J2. The flow of the toner is therefore obstructed by the accumulation portion 27J2. As a result, a toner blockage occurs in a region T in FIG. 12.

As shown in FIG. 2, to prevent this problem, the toner replenishment port 25 may be provided in the first conveyance passage 221 on the downstream side of the first direction (the arrow D1 direction) and the toner container 30 may be disposed in accordance with this position. In this case, the accumulation portion 27 formed by the first conveyance ability suppressing portion 26 is near to the first connecting passage 223 for passing the toner from the first conveyance passage 221 to the second conveyance passage 222. When the first paddle 23*c* is not provided, the toner conveyed in the first direction by the first stirring screw 23 impinges on a side wall 210*a* of the development housing 210 so as to form an accumulation. Toner overflowing from the accumulation gradually passes through the first connecting passage 223, whereby the toner is passed as described above. Therefore, toner accumulation during the passage may affect the nearby accumulation portion 27, leading to instability in replenishment toner regulation.

To solve the problem described above, occurring in relation to the accumulation portion 27 when the toner replenishment port 25 is provided in the first conveyance passage 221 on the downstream side of the first direction (the arrow D1 direction), in this embodiment, a unique innovation is implemented in relation to the arrangement of the first paddle 23*c* and the first conveyance ability suppressing portion 26. This point will be described in detail below.

Figure 5:
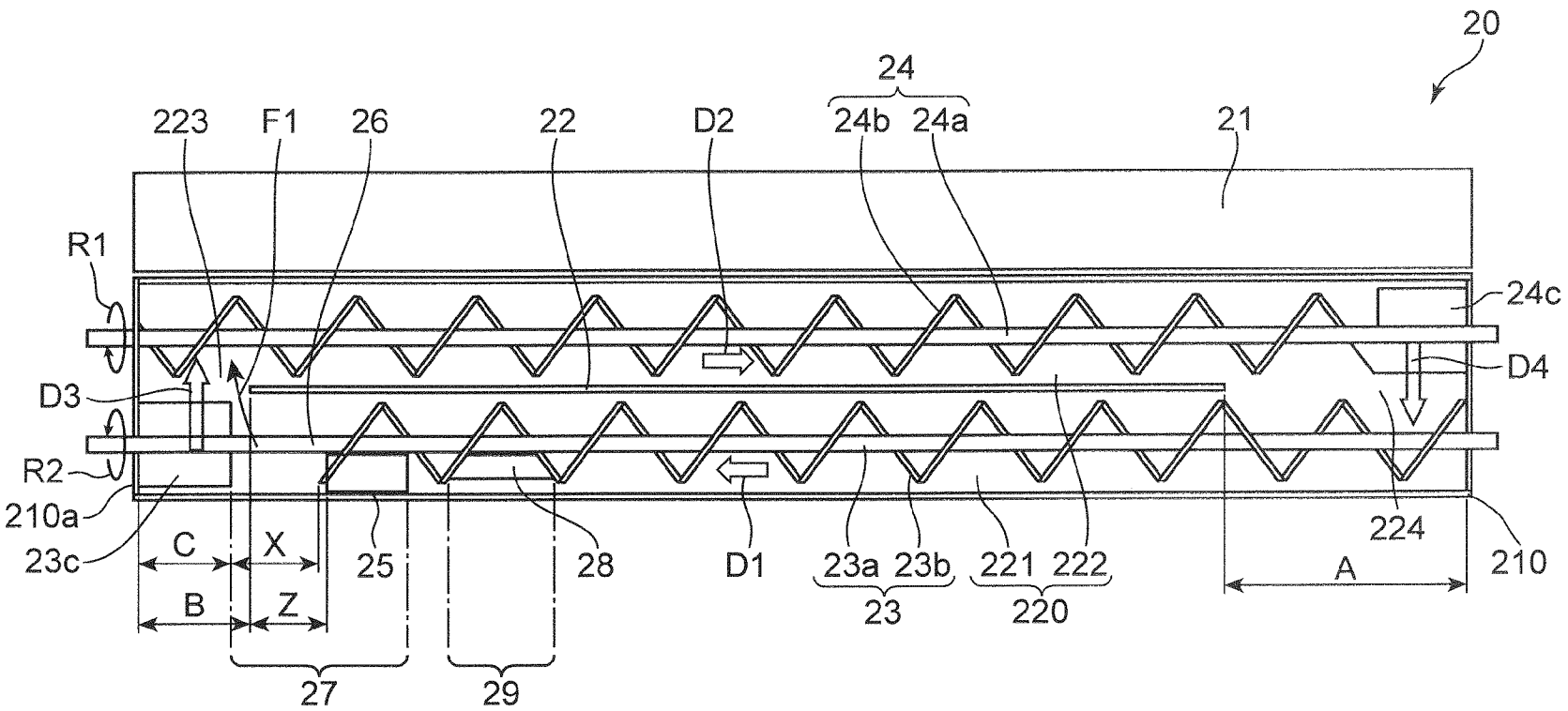
FIG. 5 is a plan view of the development device.

FIG. 5 is a view illustrating a first embodiment in which the arrangement of the first paddle 23*c* and the first conveyance ability suppressing portion 26 is set favorably. In the drawing, A represents a width of the second connecting passage 224 in the second direction, B represents a width of the first connecting passage 223 in the first direction, and C represents a first direction length of the first paddle 23*c*. Further, X represents a length of the first conveyance ability suppressing portion 26 in the first direction, and Z represents a first direction distance from a first direction downstream end of the toner replenishment port 25 to a first direction upstream end of the first connecting passage 223.

In this embodiment, shapes and arrangements of the respective members are set such that B, X, and Z satisfy a relational expression $Z<X<B$ (see FIG. 5). Thus, a first direction downstream side of the first conveyance ability suppressing portion 26 and the first paddle 23*c* (connecting conveyance portion) constituted by a plate-shaped member are disposed to face the first connecting passage 223 in the third direction (the arrow D3 direction).

The length C of the rotating first paddle 23*c* is included within the width B of the first connecting passage 223 in the first direction. Accordingly, toner positioned in the downstream end portion of the first conveyance passage 221 receives rotary force from the first paddle 23*c* so as to be passed actively to the upstream side of the second conveyance passage 222. As a result, the toner positioned in the downstream end portion of the first conveyance passage 221 is prevented from flowing back to the periphery of the first conveyance ability suppressing portion 26.

Further, the first direction downstream side of the first conveyance ability suppressing portion 26 opposes the first connecting passage 223 in the third direction. Therefore, even when excessive toner accumulates on the periphery of the first conveyance ability suppressing portion 26, the toner on the periphery of the first conveyance ability suppressing portion 26 can flow directly into the first passage 223 without passing through the first paddle 23*c*, as shown by an arrow Fl in the drawing. Hence, excessive toner in the accumulation portion 27 quickly flows out to the second conveyance passage 222 side. As a result, toner accumulation in the accumulation portion 27 is stable, and therefore the amount of supplied replenishment toner is regulated favorably.

Furthermore, since the first paddle 23*c* is constituted by a plate-shaped member, a barrier is formed between a right end portion (a first direction upstream side end portion) of the first paddle 23*c* and the first conveyance ability suppressing portion 26 when the first paddle 23*c* rotates. As a result, the toner is dammed easily, and therefore the first direction downstream side end portion (a starting end portion) of the accumulation portion 27 is secured reliably, while the toner in the accumulation portion 27 required to regulate the supply of replenishment toner is prevented from flowing out to the first connecting passage 223 side in an excessive amount.

Further, in this embodiment, the length of the first paddle 23*c* is set such that a relational expression C>(B−C) is satisfied (FIG. 5). Accordingly, a length (B−C) by which the first connecting passage 223 and the first conveyance ability suppressing portion 26 overlap in the first direction is set to be shorter than the first direction length C of the first paddle 23*c*. Hence, the accumulated toner in the accumulation portion 27 does not flow out into the first connecting passage 223 from the overlapping part in a large amount, and therefore only the excess toner in the accumulation portion 27 flows out to the second conveyance passage 222 side through the first connecting passage 223. As a result, the amount of toner in the accumulation portion 27 remains stable.

Furthermore, in this embodiment, the respective first direction widths of the first connecting passage 223 and the second connecting passage 224 are set such that a relational expression B<A is satisfied. Accordingly, a pressure of the toner is higher in the first connecting passage 223 than in the second connecting passage 224, and therefore the toner is prevented from accumulating in a large amount on the second connecting passage 224 side. As a result, toner accumulation on the circulation path can be limited to a region extending from the accumulation portion 27 to the first connecting passage 223.

Figure 6:
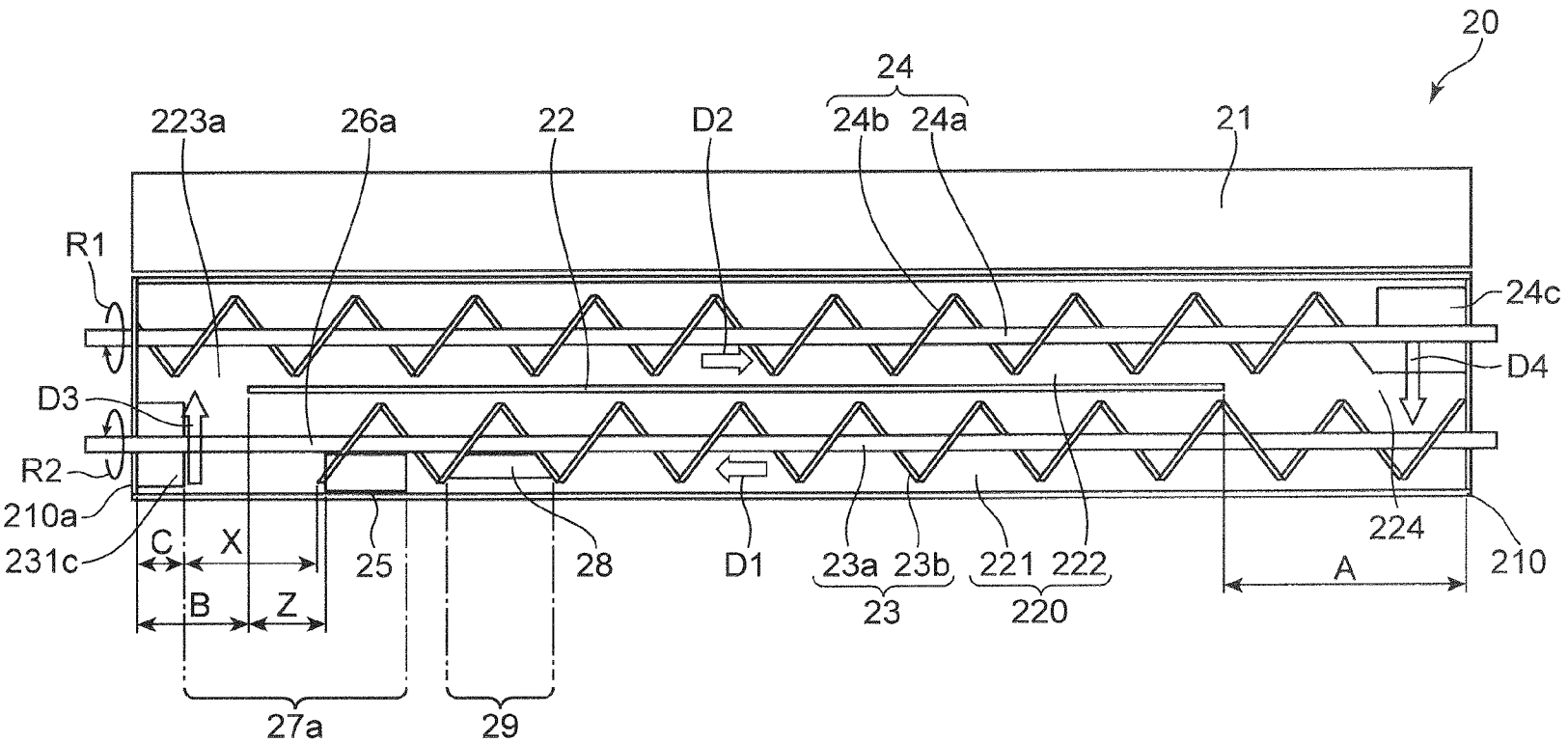
FIG. 6 is a plan view of a development device according to another embodiment of the present disclosure.

Next, a second embodiment of the first conveyance ability suppressing portion will be described on the basis of FIG. 6. In this embodiment, similarly to the first embodiment, a first conveyance ability suppressing portion 26*a* is provided on the first direction downstream side of the toner replenishment port 25, and a first paddle 231*c* is provided on a first direction downstream side of the first conveyance ability suppressing portion 26*a*. Further, the first direction downstream side part of the first conveyance ability suppressing portion 26*a* and the first paddle 231*c* oppose a first connecting passage 223*a* in the third direction. On the other hand, in the second embodiment, the relationships between B, C, X, and Z differ from those of the first embodiment, and therefore this point will be described in detail, while description of other points will be omitted.

In the second embodiment, the shapes and arrangements of the respective members are set such that relational expressions Z<B<X and C<B are satisfied. In this case, a first direction overlapping part (B−C) between the first connecting passage 223*a* and the first conveyance ability suppressing portion 26*a* is set to be larger than that of the first embodiment. In this embodiment, therefore, toner on the periphery of the first conveyance ability suppressing portion 26*a* flows to the first connecting passage 223*a* side more easily, and as a result, an accumulation portion 27*a* is less likely to form. In other words, the toner flows to the first connecting passage 223*a* side easily in a case where excessive toner is likely to accumulate in the accumulation portion 27*a* due to a fluidity, environmental conditions, and so on of the used toner, and therefore regulation of the replenishment toner supply is realized favorably.

Figure 7:
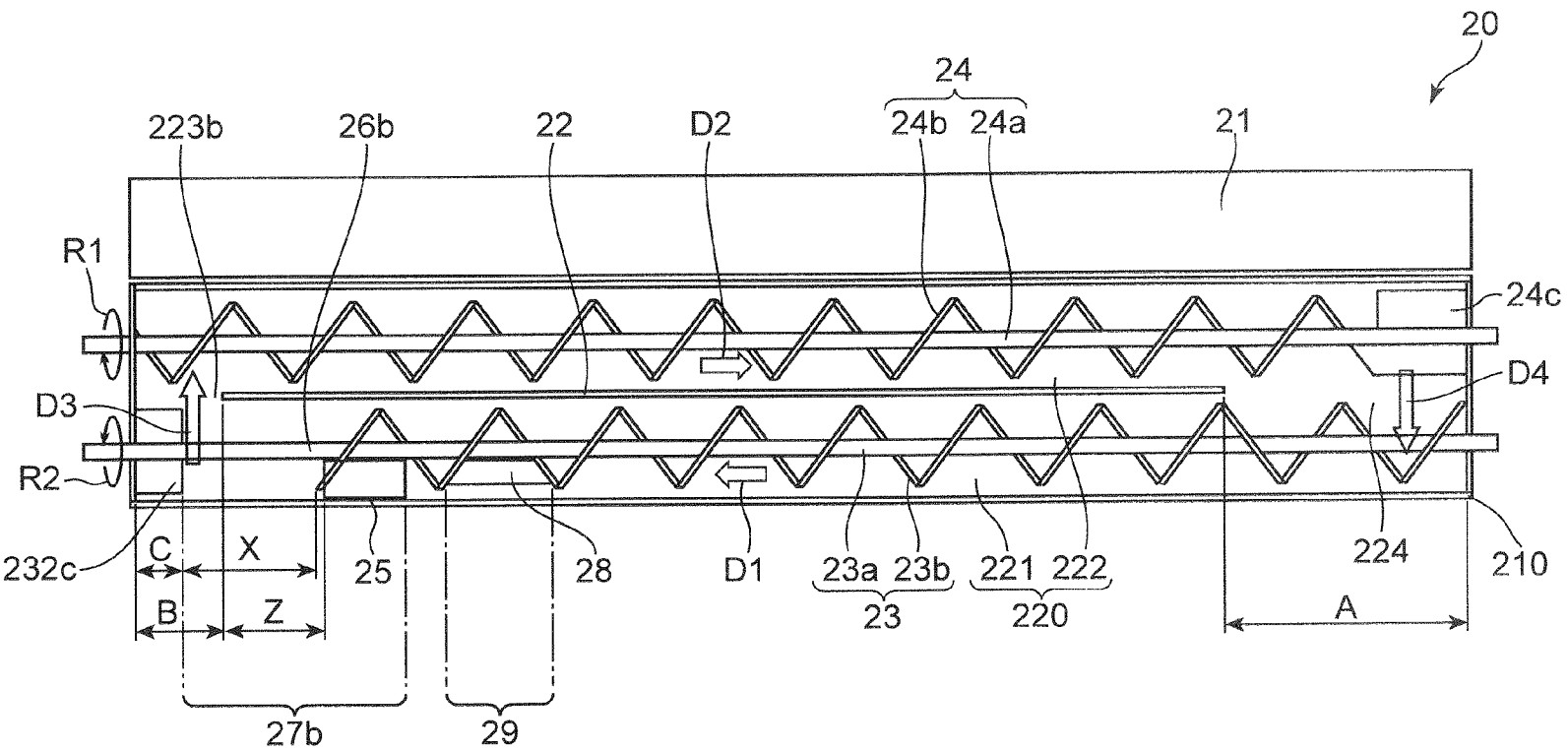
FIG. 7 is a plan view of a development device according to another embodiment of the present disclosure.

Next, a third embodiment of the first conveyance ability suppressing portion will be described on the basis of FIG. 7. In this embodiment, similarly to the first embodiment, a first conveyance ability suppressing portion 26*b* is provided on the first direction downstream side of the toner replenishment port 25, and a first paddle 232*c* is provided on a first direction downstream side of the first conveyance ability suppressing portion 26*b*. Further, the first direction downstream side part of the first conveyance ability suppressing portion 26*b* and the first paddle 232*c* oppose a first connecting passage 223*b* in the third direction. On the other hand, in the third embodiment, the relationships between B, C, X, and Z differ from those of the first embodiment, and therefore this point will be described in detail, while description of other points will be omitted.

In this embodiment, the shapes and arrangements of the respective members are set such that relational expressions B<Z<X and C<B are satisfied. In this case, in comparison with the first embodiment, the first conveyance ability suppressing portion 26*b* is set to be longer in the first direction and an accumulation portion 27*b* is formed over a longer first direction range. Further, a first direction overlapping part between the first connecting passage 223*b* and the first conveyance ability suppressing portion 26*b* is set to be smaller than a first direction length of the accumulation portion 27*b*. As a result, in this embodiment, the toner in the accumulation portion 27*b* is less likely to flow to the first connecting passage 223*b* side. In other words, the accumulation portion 27*b* is formed by the first conveyance ability suppressing portion 26*b* even in a case where a toner accumulation is unlikely to form due to the fluidity, environmental conditions, and so on of the used toner, and therefore regulation of the replenishment toner supply is realized favorably.

Figure 8:
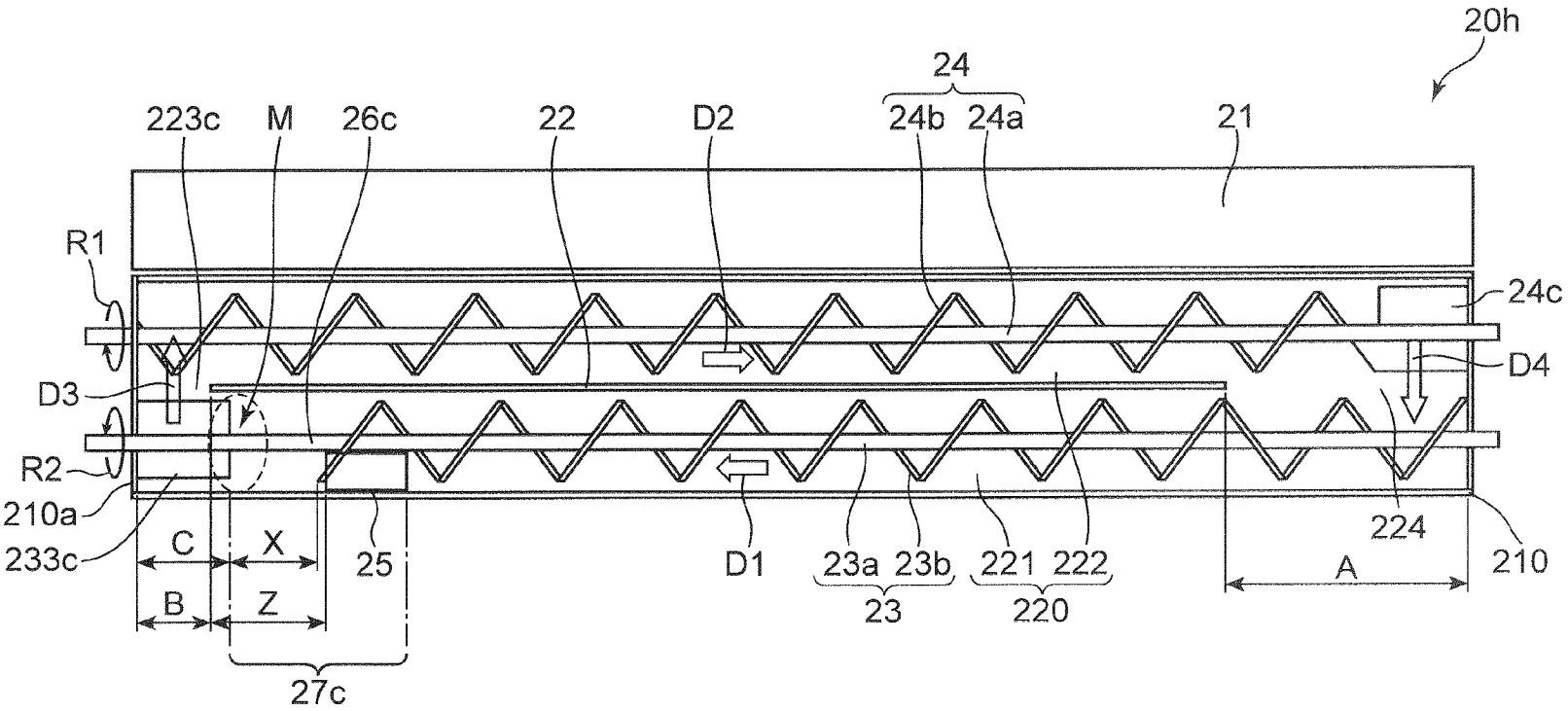
FIG. 8 is a plan view of a development device according to a comparative example.

Next, referring to FIG. 8, a first comparative example not including the configuration of the present disclosure will be described. In this comparative example, similarly to the first embodiment, a first conveyance ability suppressing portion 26*c* is provided on the first direction downstream side of the toner replenishment port 25, and a first paddle 233*c* is provided on a first direction downstream side of the first conveyance ability suppressing portion 26*c*. However, the first direction downstream side part of the first conveyance ability suppressing portion 26*c* does not oppose a first connecting passage 223*c* in the third direction. Further, in this comparative example, the relationships between B, C, X, and Z differ from those of the first embodiment, and therefore this point will be described in detail, while description of other points will be omitted.

In the first comparative example, the shapes and arrangements of the respective members are set such that relational expressions B<X<Z and B<C are satisfied. This case differs from the first embodiment in that, as described above, the first direction downstream side part of the first conveyance ability suppressing portion 26*c* does not oppose the first connecting passage 223*c* in the third direction. Therefore, toner in an accumulation portion 27*c* cannot pass through the first connecting passage 223*c* without passing through the first paddle 233*c*. Further, the first direction width B of the first connecting passage 223*c* is set to be smaller than the first direction length C of the first paddle 233*c*. Hence, a problem occurs in that excessive toner accumulates in a region M of FIG. 8. As a result, in the first comparative example, a large amount of toner accumulates regardless of whether or not replenishment toner is required, and therefore regulation of the replenishment toner supply is not realized favorably.

Figure 9:
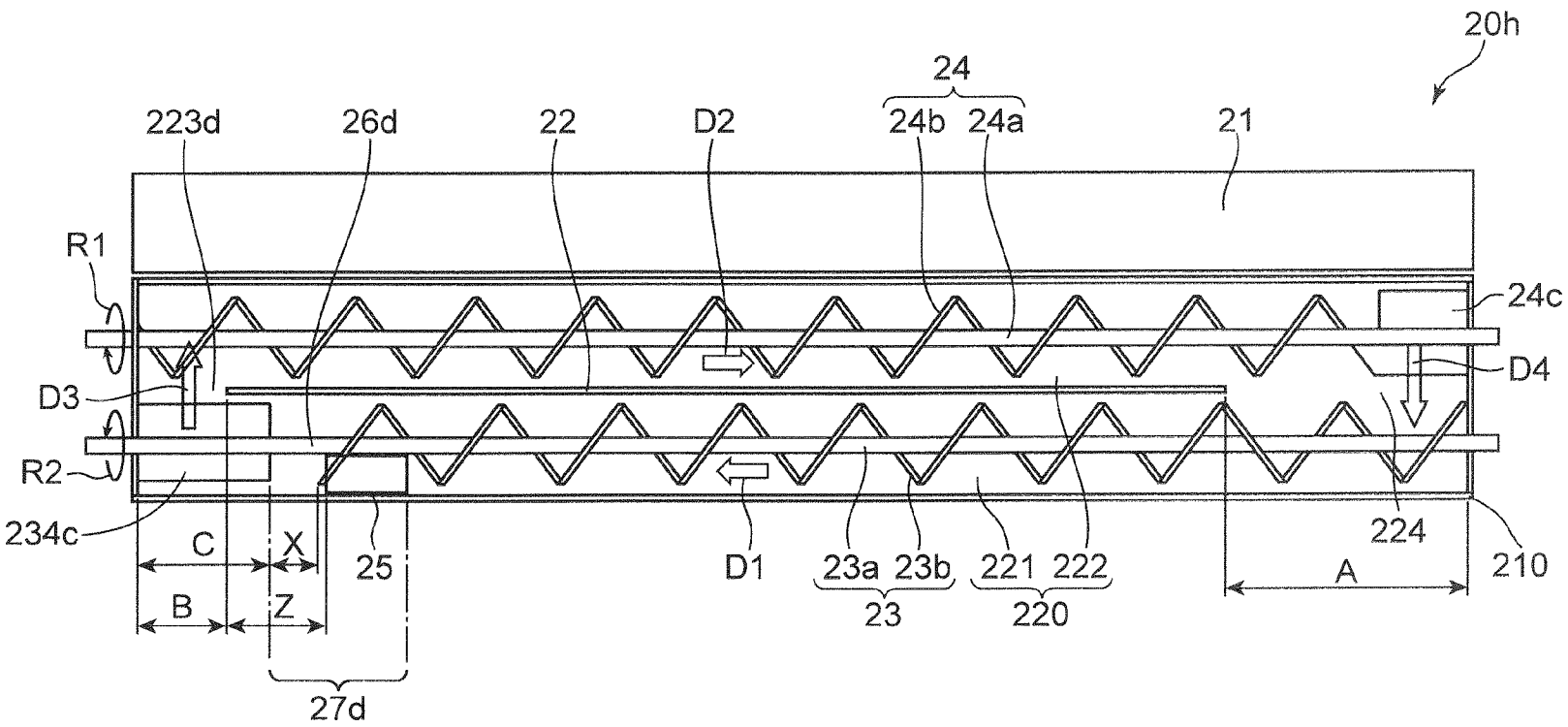
FIG. 9 is a plan view of a development device according to a comparative example.

Next, referring to FIG. 9, a second comparative example will be described. In the second comparative example, similarly to the first embodiment, a first conveyance ability suppressing portion 26*d* is provided on the first direction downstream side of the toner replenishment port 25, and a first paddle 234*c* is provided on a first direction downstream side of the first conveyance ability suppressing portion 26*d*. However, the first direction downstream side part of the first conveyance ability suppressing portion 26*d* does not oppose a first connecting passage 223*d* in the third direction. In this comparative example, the relationships between B, C, X, and Z differ from those of the first embodiment, and therefore this point will be described in detail, while description of other points will be omitted.

In the second comparative example, the shapes and arrangements of the respective members are set such that relational expressions X<B<Z and B<C are satisfied. This case differs from the first embodiment in that, as described above, the first direction downstream side part of the first conveyance ability suppressing portion 26*d* does not oppose the first connecting passage 223*d* in the third direction. Therefore, toner in an accumulation portion 27*d* cannot pass through the first connecting passage 223*d* without passing through the first paddle 234*c*. Further, the first direction length C of the first paddle 234*c* is set to be greater than the first direction width B of the first connecting passage 223*d*, with the result that the first conveyance ability suppressing portion 26*d* is set to be short. Accordingly, a part (C−B) in which the first paddle 234*c* projects from the first connecting passage 223*d* in the second direction (the arrow D2 direction) is so long that a flow of toner through the first conveyance passage 221 in the first direction is obstructed when this part rotates. Hence, the toner on the circulation path gathers on the periphery of the first paddle 234*c* such that the amount of toner in other regions decreases. As a result, the toner replenishment port 25 is sealed by the accumulation portion 27*d* at all times such that the replenishment toner cannot flow into the first conveyance passage 221. Moreover, when, in this condition, images are output continuously at a high printing rate in the image forming apparatus 1, partial toner deficiencies occur on the development roller 21, leading to image quality defects. Therefore, with the second comparative example, regulation of the replenishment toner supply is not realized favorably, and moreover, a toner balance on the circulation path is disturbed, causing image quality defects.

Figure 10:
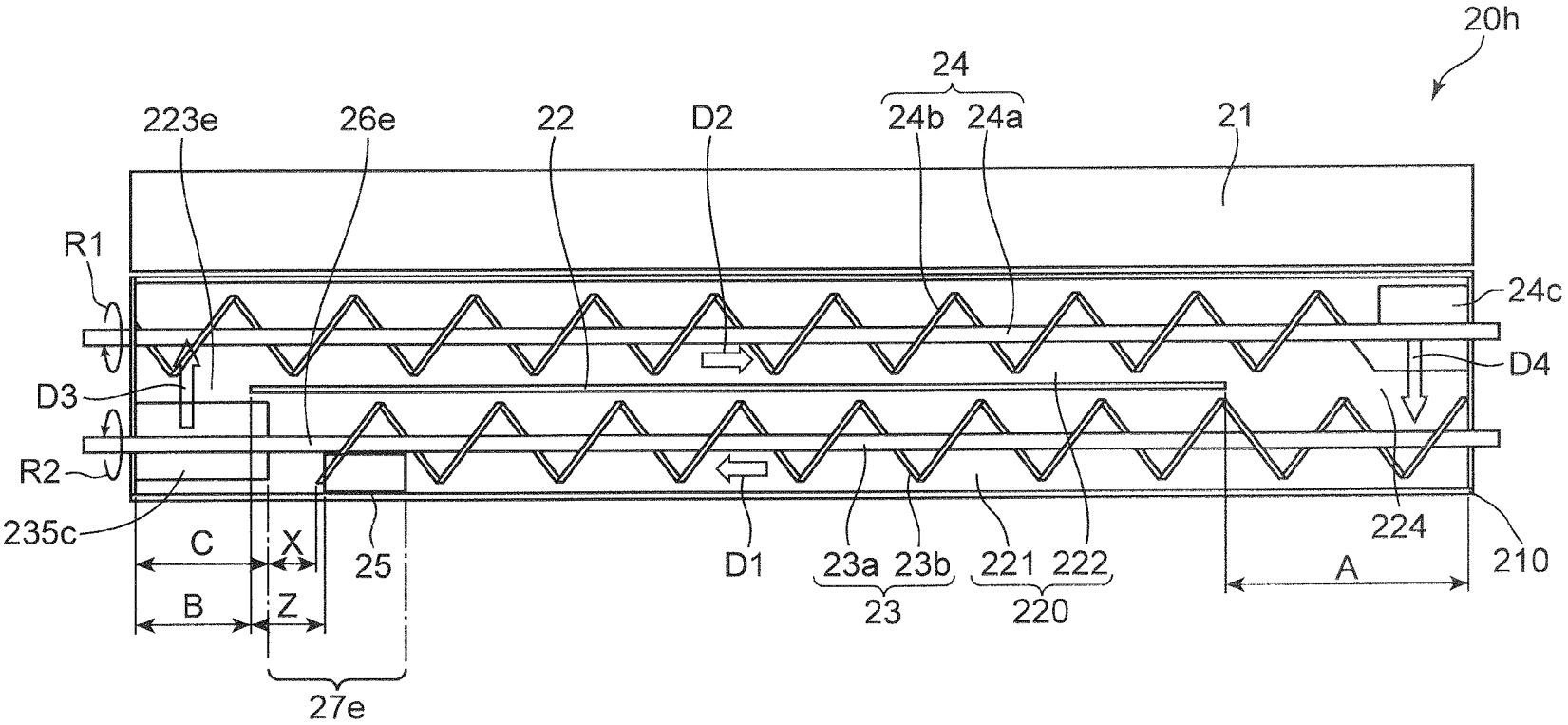
FIG. 10 is a plan view of a development device according to a comparative example.

Next, referring to FIG. 10, a third comparative example will be described. In the third comparative example, similarly to the first embodiment, a first conveyance ability suppressing portion 26*e* is provided on the first direction downstream side of the toner replenishment port 25, and a first paddle 235*c* is provided on a first direction downstream side of the first conveyance ability suppressing portion 26*e*. However, the first direction downstream side part of the first conveyance ability suppressing portion 26*e* does not oppose a first connecting passage 223*e* in the third direction. In the third comparative example, the relationships between B, C, X, and Z differ from those of the first embodiment, and therefore this point will be described in detail, while description of other points will be omitted.

In the third comparative example, the shapes and arrangements of the respective members are set such that relational expressions X<Z<B and B<C are satisfied. This case differs from the first embodiment in that, as described above, the first direction downstream side part of the first conveyance ability suppressing portion 26*e* does not oppose the first connecting passage 223*e* in the third direction. Therefore, toner in an accumulation portion 27*e* cannot pass through the first connecting passage 223*e* without passing through the first paddle 235*c*. Further, the first direction length C of the first paddle 235*c* is set to be slightly greater than the first direction width B of the first connecting passage 223*e*, and the first conveyance ability suppressing portion 26*e* is set to be short. As a result, the amount of toner in the accumulation portion 27*e* formed by the first conveyance ability suppressing portion 26*e* is small, whereby excessive replenishment toner flows into the first conveyance passage 221. Moreover, a part (C−B) in which the first paddle 235*c* projects from the first connecting passage 223*e* in the second direction (the arrow D2 direction) is short, and therefore the first paddle 235*c* possesses little force for blocking the toner conveyed in the first direction. As a result, the circulation path does not include a region where the toner gathers and accumulates, and therefore an amount of toner distributed over the entire circulation path increases, leading to an increase in a drive torque of a development device 20*h*. Hence, with the third comparative example, regulation of the replenishment toner supply is not realized favorably, and moreover, the toner balance on the circulation path is disturbed, causing defects in the drive torque of the development device 20*h*.

As described above, in the first to third embodiments, the first conveyance ability suppressing portion 26 (26*a*, 26*b*) is provided on the first direction downstream side of the toner replenishment port 25, and the first paddle 23*c* (231*c*, 232*c*) is provided on the first direction downstream side of the first conveyance ability suppressing portion 26 (26*a*, 26*b*). Further, the first direction downstream side part of the first conveyance ability suppressing portion 26 (26*a*, 26*b*) and the first paddle 23*c* (231*c*, 232*c*) oppose the first connecting passage 223 (223*a*, 223*b*) in the third direction. Therefore, in contrast to the first to third comparative examples, the toner accumulates in the accumulation portion 27 (27*a*, 27*b*) with stability such that regulation of the replenishment toner supply is realized favorably.

<Re: Upstream Side Accumulation Portion>

Next, the upstream side accumulation portion 29 formed by the second conveyance ability suppressing portion 28 will be described. First, a reason why the second conveyance ability suppressing portion 28 needs to be provided in the development device 20 including the first conveyance ability suppressing portion 26 that forms the accumulation portion 27 will be described.

In the volume replenishment type toner replenishment method described above, when the amount of replenishment toner T2 housed in the toner container 30 varies rapidly, the replenishment toner T2 may flow rapidly into the interior space 220 of the development housing 210. This phenomenon occurs particularly strikingly when a residual amount of toner in the toner container 30 attached to the development device 20 decreases such that the toner container 30 is replaced with a new toner container 30 by a user. This phenomenon will be described below with reference to FIGS. 13A and 13B.

Figure 13A:
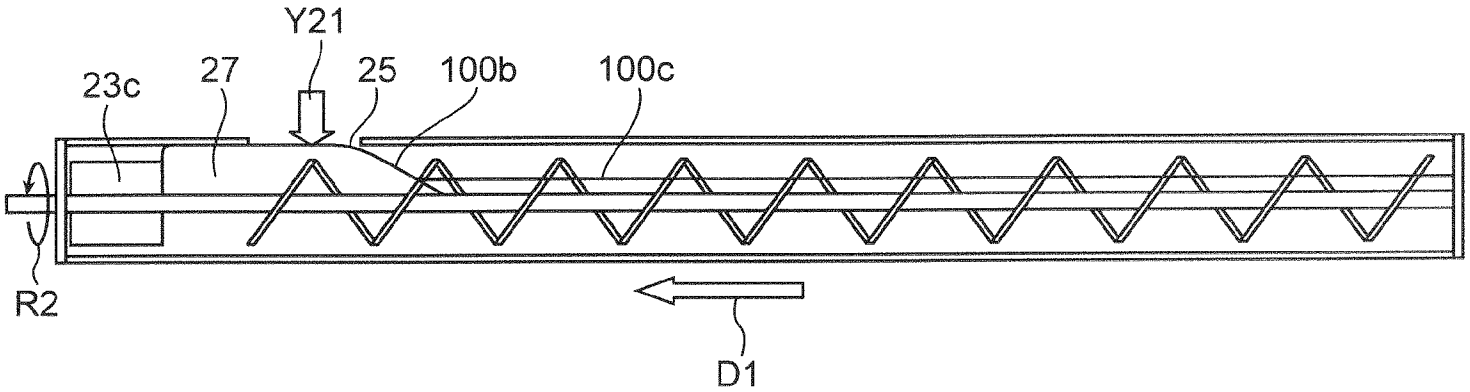
FIGS. 13A and 13B are pattern diagrams showing volume replenishment type toner replenishment.
Figure 13B:
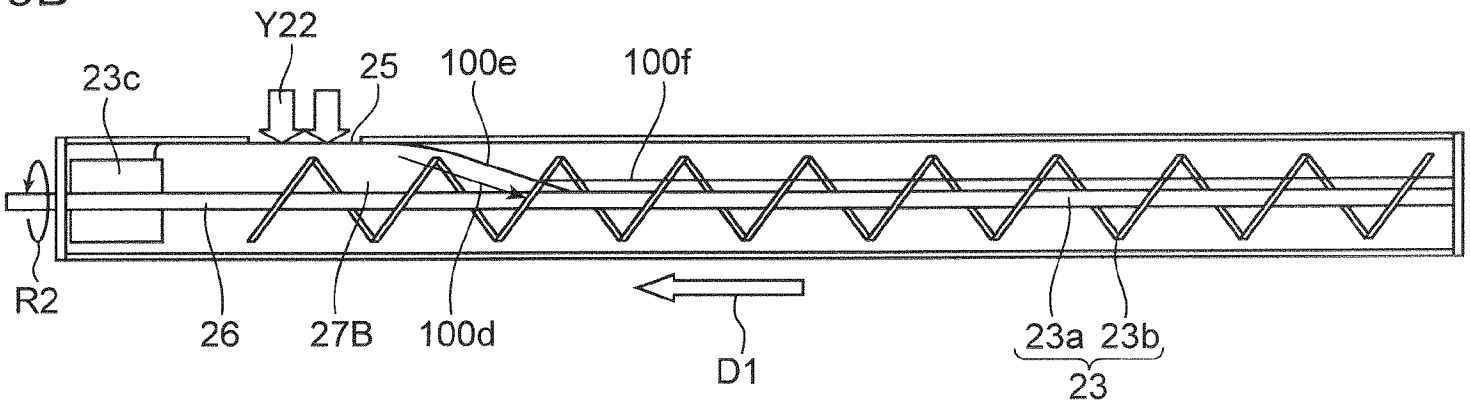

FIGS. 13A and 13B are sectional views showing the first passage 221 in the development housing 220 from the horizontal direction. In both drawings, toner flows into a right end of the first conveyance passage 221 in the drawings from the second connecting passage 224. The toner conveyed through the first conveyance passage 221 by the first stirring screw 23 is passed to the second conveyance passage 222 side on a left end of the first conveyance passage 221 in the drawings by the first paddle 23*c*. Further, in both FIG. 13A and FIG. 13B, the toner container 30, not shown in the drawings, is disposed above the toner replenishment port 25 provided on the downstream side of the first conveyance passage 221. FIGS. 13A and 13B show a manner in which a toner distribution in the first conveyance passage 221 varies in accordance with differences in the amount of toner in the toner container 30.

FIG. 13A shows a condition of the first conveyance passage 221 when the amount of toner in the toner container 30 is small. FIG. 13B shows a condition in which the toner container 30 has been replaced with a new toner container 30 from the condition shown in FIG. 13A. In FIG. 13A, the amount of replenishment toner T2 that can fall through the toner discharge port 33 is small, and therefore a downward pressure applied by the replenishment toner T2 to the accumulation portion 27 is small (arrow Y21). Accordingly, a pressure required for the accumulation portion 27 to seal the toner replenishment port 25 from below is also small. Hence, the replenishment toner T2 and the toner in the accumulation portion 27 press against each other by a small pressure such that equilibrium is maintained therebetween, and as a result, the toner replenishment port 25 is sealed. At this time, the toner T1 in the first conveyance passage 221 is distributed between the accumulation portion 27 covering the toner replenishment port 25, a first upstream portion 100*b* distributed directly upstream of the toner replenishment port 25 and having an inclined surface, and a second upstream portion 100*c* distributed further upstream and having a substantially horizontal, stable draft surface.

Here, when the residual amount of toner in the toner container 30 decreases, the user is warned thereof by display means, not shown in the drawings, provided on the image forming apparatus 1. At an appropriate time, the user detaches the old toner container 30 and attaches a new toner container 30 to the development device 20. A large amount of toner is housed in the interior of the new toner container 30, and therefore the amount of replenishment toner T2 attempting to fall through the toner discharge port 33 toward the toner replenishment port 25 increases rapidly when the toner container 30 is replaced.

Accordingly, the downward pressure applied by the replenishment toner T2 to the accumulation portion 27 in the toner replenishment port 25 increases (arrow Y22). Moreover, the downward pressure applied by the replenishment toner T2 to the accumulation portion 27 in the toner replenishment port 25 exceeds an upward pressure applied by the accumulation portion 27 to the replenishment toner T2. As a result, the replenishment toner T2 advances through the first conveyance passage 221 to the first upstream portion 100*b* side (arrow 100*d*) where a pressure (a sealing pressure) exerted on the toner replenishment port 25 is weak. The advancing toner forms a sudden toner inflow that is outside the regulation range, and differs from the flow of replenishment toner flowing in through the toner replenishment port 25 in that the amount of developer in the accumulation portion 27 decreases relative to the amount of toner consumed via the development roller 21.

When, following replacement of the toner container 30, the development device 20 is controlled to rotate the first stirring screw 23 and the second stirring screw 24, the toner distribution in the interior space 220 varies due to the inflowing replenishment toner T2 described above. In other words, as shown in FIG. 13B, when the amount of toner in the interior space 220 increases rapidly, the amount of toner accumulated by the first conveyance ability suppressing portion 26 also increases. As a result, the accumulation portion 27 spreads to the upstream side of the toner replenishment port 25 such that the second accumulation portion 27B is formed. Further, the first upstream portion 100*b* and the second upstream portion 100*c* respectively shift to the upstream side in the toner conveyance direction (the arrow D1 direction) such that a third upstream portion 100*e* and a fourth upstream portion 100*f* are formed. The second accumulation portion 27B blocks the toner replenishment port 25 from both the upstream side and the downstream side by a larger amount of toner than the accumulation portion 27, and therefore, eventually, advancement of the replenishment toner T2 flowing in immediately after replacement of the toner container 30 is suppressed.

Hence, when a toner container 30 housing a small amount of toner in its interior is replaced with a new toner container 30 housing a large amount of toner, the pressure exerted by the replenishment toner T2 in the toner replenishment port 25 varies such that a large amount of replenishment toner T2 flows into the first conveyance passage 221 rapidly. In this case, the replenishment toner T2 and the toner T1 housed in the first conveyance passage 221 cannot be stirred and mixed together quickly, and therefore unevenness occurs in the toner charge. Unevenly charged toner causes toner fogging on the photosensitive drum 14 following development.

Figure 4:
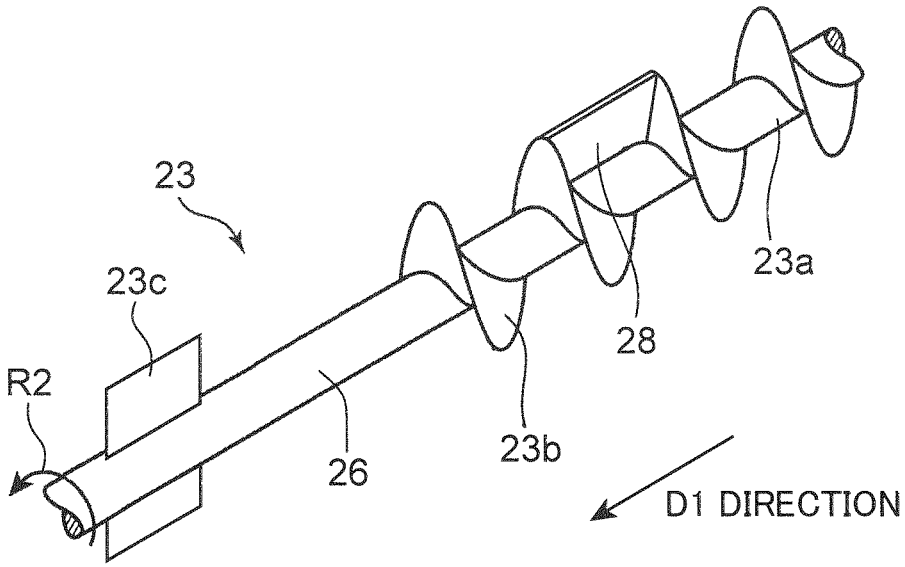
FIG. 4 is a perspective view of a stirring screw.

To solve the problem described above, in which a large amount of toner flows rapidly to the development device 20 side when the amount of toner in the toner container 30 varies, in this embodiment, the first stirring screw 23 includes the second conveyance ability suppressing portion 28 (to be referred to hereafter as a suppression paddle 28) in a position in the first conveyance passage 221 on the upstream side of the toner replenishment port 25 in the toner conveyance direction (the arrow D1 direction) (see FIGS. 2, 4, and so on).

The suppression paddle 28 is a plate-shaped rib member that spans two adjacent first spiral vanes 23*b* in the arrow D1 direction so as to extend in a rotation radius direction of the first rotary shaft 23*a*. The suppression paddle 28 rotates in the arrow R2 direction in accompaniment with the rotation of the first stirring screw 23 so as to convey the toner T1 conveyed through the first conveyance passage 221 in the R2 direction. Hence, the ability to convey the toner T1 in the arrow D1 direction is suppressed on a periphery of the suppression paddle 28 such that the toner T1 accumulates. The upstream side accumulation portion 29 is formed in the first conveyance passage 221 directly upstream of the toner replenishment port 25 by the accumulated toner T1.

Figure 14A:
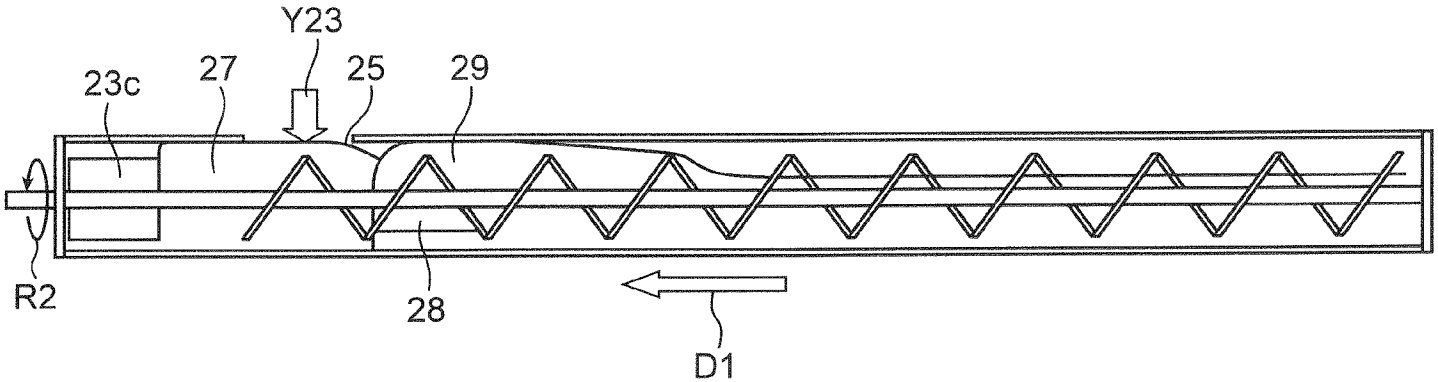
FIGS. 14A and 14B are pattern diagrams showing toner replenishment according to an embodiment of the present disclosure.
Figure 14B:
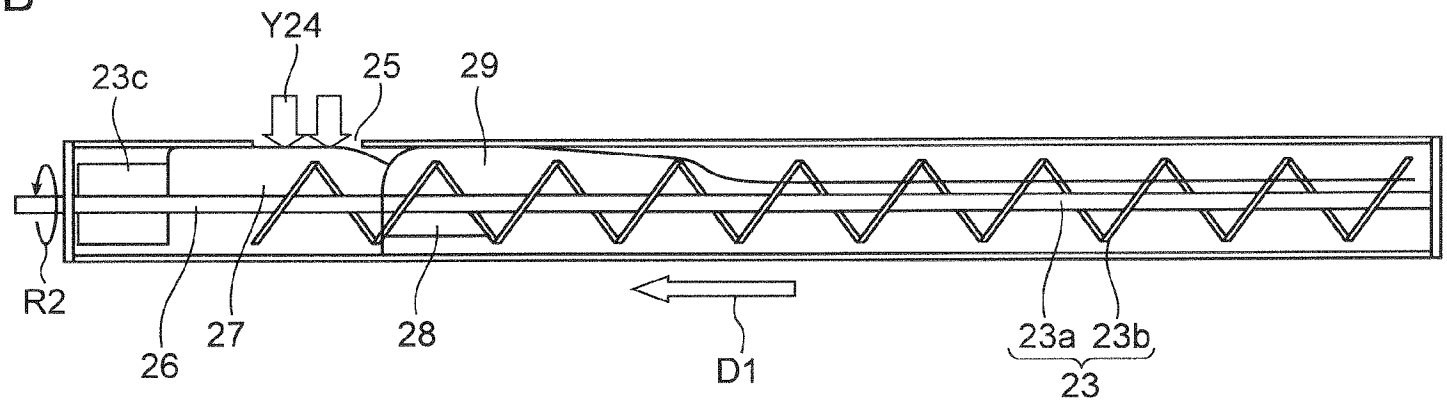

Referring to FIGS. 14A and 14B, the toner distribution through the development device 20 including the suppression paddle 28 according to this embodiment will be described. FIGS. 14A and 14B are sectional views showing the first conveyance passage 221 in the development housing 220 from the horizontal direction. FIG. 14A shows a condition of the interior space 220 when the amount of toner in the toner container 30 is small. FIG. 14B shows a condition in which the toner container 30 has been replaced with a new toner container 30 from the condition shown in FIG. 14A. In FIG. 14A, the accumulation portion 27 is formed in the first conveyance passage 221 by the first conveyance ability suppressing portion 26 in a position opposing the toner replenishment port 25, as described above. Further, the upstream side accumulation portion 29 is formed directly upstream of the toner replenishment port 25 by the suppression paddle 28.

The upstream side accumulation portion 29 accumulates so as to block the first conveyance passage 221 on the upstream side of the toner replenishment port 25. When the amount of toner in the toner container 30 is small, the downward pressure applied by the replenishment toner T2 to the accumulation portion 27 in the toner replenishment port 25 is small (arrow Y23). In this case, the accumulation portion 27 and the upstream side accumulation portion 29 block the periphery of the toner replenishment port 25 on the first conveyance passage 221 side such that upward pressure is exerted on the replenishment toner T2. As a result, the replenishment toner T2 stops in the vicinity of the toner replenishment port 25 rather than flowing into the interior space 220.

When the toner container 30 is replaced with a new toner container 30, the amount of toner housed therein is large, and therefore the downward pressure applied by the replenishment toner T2 to the accumulation portion 27 in the toner replenishment port 25 increases. In this embodiment, however, the accumulation portion 27 and the upstream side accumulation portion 29 apply upward pressure to the replenishment toner T2 in the toner replenishment port 25 likewise in this case, and therefore the replenishment toner T2 does not flow rapidly into the first conveyance passage 221 (FIG. 14B). In particular, the upstream side of the toner replenishment port 25, to which the replenishment toner T2 advances easily when the suppression paddle 28 is not provided, is sealed by the upstream side accumulation portion 29, and therefore the replenishment toner T2 is prevented from flowing rapidly into the first conveyance passage 221.

Hence, the suppression paddle 28 has a function for forming the upstream side accumulation portion 29, and the upstream side accumulation portion 29 has a function for sealing the upstream side of the toner replenishment port 25. Furthermore, the suppression paddle 28 is disposed in an outermost position in a radial direction of the first spiral vane 23*b*, and therefore the rotating suppression paddle 28 forms a barrier directly upstream of the toner replenishment port 25 in a region in the vicinity of an inner peripheral surface of the development housing 210 on an orthogonal cross-section to the first rotary shaft 23*a*. As a result, the replenishment toner T2 is prevented from flowing to the upstream side of the toner replenishment port 25 following replacement of the toner container 30 even more reliably.

The toner in the interior space 220 is consumed on the photosensitive drum 14 side via the development roller 21, and when the amount of developer in the accumulation portion 27 and the upstream side accumulation portion 29 decreases, the replenishment toner T2 flows into the interior space 220 (the first conveyance passage 221).

As described above, with the development device 20 according to this embodiment, rapid toner inflow into the development housing 210, which is likely to occur following replacement of the toner container 30, is suppressed. Therefore, a stirring deficiency between the rapidly inflowing toner and the toner in the development housing 210 is unlikely to occur, and as a result, toner fogging on the photosensitive drum 14 is suppressed.

The development device 20 according to an embodiment of the present disclosure was described above, but the present disclosure is not limited thereto, and the following modified embodiments, for example, may be employed.

(1) In the embodiment described above, a part in which the first spiral vane 23*b* is removed from the first stirring screw 23 is used as the first conveyance ability suppressing portion 26. Alternatively, a rod member that is parallel to the first rotary shaft 23*a* may be disposed on a peripheral edge portion of the first spiral vane 23*b* of the first stirring screw 23, and a part to which the rod member is annexed may be used as the first conveyance ability suppressing portion 26. The toner conveyance ability is suppressed by the rod member annexed to the first spiral vane 23*b* such that the toner accumulates in the first conveyance passage 221.

(2) In the embodiment described above, a plate-shaped member disposed on the first rotary shaft 23*a* is used as the first paddle 23*c*. However, the present disclosure is not limited thereto, and instead, a rod-shaped member disposed parallel to the first rotary shaft 23*a* may be disposed on the first rotary shaft 23*a*. Further, a tip end of the plate-shaped member may be bent into a dogleg shape in order to improve the toner passing ability, and so on.

(3) In the embodiment described above, the suppression paddle 28 serves as the second conveyance ability suppressing portion to form the upstream side accumulation portion 29. However, the present disclosure is not limited thereto, and instead, for example, the second conveyance ability suppressing portion may be formed by partially providing only the first rotary shaft 23*a*, or in other words partially removing the first spiral vanes 23*b*. In this case, the toner conveyance ability in the direction of the first rotary shaft 23*a* (the arrow D1 direction) decreases such that the upstream side accumulation portion 29 is formed similarly. The second conveyance ability suppressing portion may also be formed by partially reducing an outer diameter of the first spiral vane 23*b*.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A development device comprising:

a casing that houses a developer;

a replenishment developer housing portion that is attached to said casing detachably and houses replenishment developer supplied to said casing;

a developer conveyance path that is formed in said casing and includes a first conveyance passage through which said developer is conveyed in a first direction, a second conveyance passage which is disposed alongside said first conveyance passage and through which said developer is conveyed in a second direction, which is an opposite direction to said first direction, a first connecting passage which connects a downstream side of said first conveyance passage to an upstream side of said second conveyance passage in a third direction that intersects said first direction, and a second connecting passage which connects a downstream side of said second conveyance passage to an upstream side of said first conveyance passage in a fourth direction, which is an opposite direction to said third direction;

a developer introduction port that is provided in said casing to oppose a first direction downstream side position of said first conveyance passage, and through which said replenishment developer is introduced into said developer conveyance path from said replenishment developer housing portion;

a developer conveyance portion disposed in said first conveyance passage and comprising a rotary shaft and a screw vane formed around said rotary shaft, rotation of said screw vane conveying said developer in said first direction so that said developer passes said position in which said developer introduction port opposes said first conveyance passage;

a first conveyance ability suppressing portion that is disposed on said developer conveyance portion on a downstream side of said developer introduction port in said first direction in order to partially suppress a developer conveyance ability of said developer conveyance portion such that a developer accumulation portion for regulating an introduction amount of said replenishment developer is formed in a position opposing said developer introduction port, and such that a first direction downstream side thereof opposes said first connecting passage in said third direction; and a connecting conveyance portion that is joined to said first direction downstream side of said first conveyance ability suppressing portion in said developer conveyance portion and opposes said first connecting passage in said third direction in order to pass said developer from said first conveyance passage to said second conveyance passage, wherein when a distance in said first direction from a first direction downstream end of said developer introduction port to a first direction upstream end of said first connecting passage is Z, a length of said first conveyance ability suppressing portion in said first direction is X, and a width of said first connecting passage in said first direction is B, a relational expression $Z<X<B$ is satisfied.

2. The development device according to claim 1, wherein said first conveyance ability suppressing portion is formed by removing said screw vane.

3. The development device according to claim 1, wherein said connecting conveyance portion is a plate-shaped member that is disposed on said rotary shaft and rotates together with said rotary shaft.

4. A development device, comprising:

a casing that houses a developer;

a replenishment developer housing portion that is attached to said casing detachably and houses replenishment developer supplied to said casing;

a developer conveyance path that is formed in said casing and includes a first conveyance passage through which said developer is conveyed in a first direction, a second conveyance passage which is disposed alongside said first conveyance passage and through which said developer is conveyed in a second direction, which is an opposite direction to said first direction, a first connecting passage which connects a downstream side of said first conveyance passage to an upstream side of said second conveyance passage in a third direction that intersects said first direction, and a second connecting passage which connects a downstream side of said second conveyance passage to an upstream side of said first conveyance passage in a fourth direction, which is an opposite direction to said third direction;

a developer introduction port that is provided in said casing to oppose a first direction downstream side position of said first conveyance passage, and through which said replenishment developer is introduced into said developer conveyance path from said replenishment developer housing portion;

a developer conveyance portion disposed in said first conveyance passage and comprising a rotary shaft and a screw vane formed around said rotary shaft, rotation of said screw vane conveying said developer in said first direction so that said developer passes said position in which said developer introduction port opposes said first conveyance passage;

a first conveyance ability suppressing portion that is disposed on said developer conveyance portion on a downstream side of said developer introduction port in said first direction in order to partially suppress a developer conveyance ability of said developer conveyance portion such that a developer accumulation portion for regulating an introduction amount of said replenishment developer is formed in a position opposing said developer introduction port, and such that a first direction downstream side thereof opposes said first connecting passage in said third direction; and a connecting conveyance portion that is joined to said first direction downstream side of said first conveyance ability suppressing portion in said developer conveyance portion and opposes said first connecting passage in said third direction in order to pass said developer from said first conveyance passage to said second conveyance passage, wherein when a distance in said first direction from a first direction downstream end of said developer introduction port to a first direction upstream end of said first connecting passage is Z, a length of said first conveyance ability suppressing portion in said first direction is X, a width of said first connecting passage in said first direction is B, and a length of said connecting conveyance portion in said first direction is C, relational expressions $Z<B<X$ and $C<B$ are satisfied.

5. A development device, comprising:

a casing that houses a developer;

a replenishment developer housing portion that is attached to said casing detachably and houses replenishment developer supplied to said casing;

a developer conveyance path that is formed in said casing and includes a first conveyance passage through which said developer is conveyed in a first direction, a second conveyance passage which is disposed alongside said first conveyance passage and through which said developer is conveyed in a second direction, which is an opposite direction to said first direction, a first connecting passage which connects a downstream side of said first conveyance passage to an upstream side of said second conveyance passage in a third direction that intersects said first direction, and a second connecting passage which connects a downstream side of said second conveyance passage to an upstream side of said first conveyance passage in a fourth direction, which is an opposite direction to said third direction;

a developer introduction port that is provided in said casing to oppose a first direction downstream side position of said first conveyance passage, and through which said replenishment developer is introduced into said developer conveyance path from said replenishment developer housing portion;

a developer conveyance portion disposed in said first conveyance passage and comprising a rotary shaft and a screw vane formed around said rotary shaft, rotation of said screw vane conveying said developer in said first direction so that said developer passes said position in which said developer introduction port opposes said first conveyance passage;

a first conveyance ability suppressing portion that is disposed on said developer conveyance portion on a downstream side of said developer introduction port in said first direction in order to partially suppress a developer conveyance ability of said developer conveyance portion such that a developer accumulation portion for regulating an introduction amount of said replenishment developer is formed in a position opposing said developer introduction port, and such that a first direction downstream side thereof opposes said first connecting passage in said third direction; and a connecting conveyance portion that is joined to said first direction downstream side of said first conveyance ability suppressing portion in said developer conveyance portion and opposes said first connecting passage in said third direction in order to pass said developer from said first conveyance passage to said second conveyance passage, wherein when a distance in said first direction from a first direction downstream end of said developer introduction port to a first direction upstream end of said first connecting passage is Z, a length of said first conveyance ability suppressing portion in said first direction is X, a width of said first connecting passage in said first direction is B, and a length of said connecting conveyance portion in said first direction is C, relational expressions $B<Z<X$ and $C<B$ are satisfied.

6. The development device according to claim 1, further comprising a second conveyance ability suppressing portion disposed on said developer conveyance portion on an upstream side of said developer introduction port in said first direction in order to partially suppress said developer conveyance ability of said developer conveyance portion such that an upstream side developer accumulation portion is formed on an upstream side of said developer introduction port in said first direction.

7. The development device according to claim 6, wherein said developer conveyance portion comprises a rotary shaft and a screw vane formed around said rotary shaft, said developer is conveyed by a rotation of said screw vane, and said second conveyance ability suppressing portion is formed by annexing a plate-shaped member that extends in a rotation radius direction of said rotary shaft to said rotary shaft or said screw vane.

8. The development device according to claim 6, wherein said developer conveyance portion comprises a rotary shaft and a screw vane formed around said rotary shaft, said developer is conveyed by a rotation of said screw vane, and said second conveyance ability suppressing portion is formed by partially reducing an outer diameter of said screw vane.

9. The development device according to claim 6, wherein said developer conveyance portion comprises a rotary shaft and a screw vane formed around said rotary shaft, said developer is conveyed by a rotation of said screw vane, and said second conveyance ability suppressing portion is formed by removing said screw vane.

10. An image forming apparatus comprising:

an image carrier that has a surface on which an electrostatic latent image is formed, with said electrostatic latent image being formed into a visible developer image using a developer; and the development device of claim 1 that supplies said developer to said image carrier.

11. An image forming apparatus comprising:

an image carrier that has a surface on which an electrostatic latent image is formed, with said electrostatic latent image being formed into a visible developer image using a developer; and the development device of claim 4 that supplies said developer to said image carrier.

12. An image forming apparatus comprising:

an image carrier that has a surface on which an electrostatic latent image is formed, with said electrostatic latent image being formed into a visible developer image using a developer; and the development device of claim 5 that supplies said developer to said image carrier.

* * * * *